US007874429B2

(12) United States Patent
Londino

(10) Patent No.: US 7,874,429 B2
(45) **Date of Patent: *Jan. 25, 2011**

(54) MEDICATION DOSAGE REMINDER AND CONFIRMATION DEVICE, SYSTEM, METHOD, AND PRODUCT-BY-PROCESS

(76) Inventor: Patricia Londino, 123 Colorado Ave., Watertown, NY (US) 13601

( * ) Notice: Subject to any disclaimer, the term of this patent is extended or adjusted under 35 U.S.C. 154(b) by 169 days.

This patent is subject to a terminal disclaimer.

(21) Appl. No.: 12/135,293

(22) Filed: Jun. 9, 2008

(65) Prior Publication Data

US 2008/0236475 A1 Oct. 2, 2008

Related U.S. Application Data

(63) Continuation of application No. 11/163,648, filed on Oct. 26, 2005, now Pat. No. 7,387,208.

(51) Int. Cl.
*B24D 15/00* (2006.01)

(52) U.S. Cl. ..... 206/534; 283/51; 283/900; 40/121; 116/308

(58) Field of Classification Search ..... 206/534, 206/459.1, 459.5; 283/51, 900, 62, 81, 52.1; 116/308; 40/121, 5
See application file for complete search history.

(56) References Cited

U.S. PATENT DOCUMENTS

| | | | | |
|---|---|---|---|---|
| 2,794,545 | A | 6/1957 | Olson | |
| 2,831,278 | A | 4/1958 | Myers | |
| 2,833,064 | A | 5/1958 | Parker | |
| 2,888,159 | A | 5/1959 | Fields | |
| 3,579,883 | A | 5/1971 | Hayes | |
| 3,675,620 | A | 7/1972 | Baustin | |
| 4,534,468 | A | 8/1985 | Nuckols et al. | |
| 4,621,442 | A | 11/1986 | Mack | |
| 4,661,188 | A | 4/1987 | Fumei | |
| 4,752,087 | A | 6/1988 | Weisbach | |
| 4,830,407 | A | 5/1989 | Sadler, Jr. et al. | |
| 5,313,439 | A | 5/1994 | Albeck | |
| 5,431,450 | A | 7/1995 | Coleman | |
| 5,454,484 | A | 10/1995 | Chelossi | |
| 5,605,230 | A | 2/1997 | Marino et al. | |
| 5,639,529 | A | 6/1997 | Gozdecki et al. | |
| 5,660,138 | A | 8/1997 | Hirsch | |
| 5,881,597 | A | 3/1999 | Brooks | |
| 5,915,854 | A * | 6/1999 | Burke et al. | 40/491 |
| 5,979,698 | A | 11/1999 | Deal | |
| 6,047,488 | A | 4/2000 | Tuszkiewicz | |
| 6,250,545 | B1 | 6/2001 | Mazzarolo et al. | |
| 6,550,171 | B1 | 4/2003 | De Werra et al. | |
| 6,581,972 | B2 | 6/2003 | Nojima et al. | |
| 6,685,227 | B2 | 2/2004 | Merry et al. | |
| 6,770,345 | B2 | 8/2004 | Sellars | |
| 6,951,353 | B2 * | 10/2005 | Kozlowski et al. | 283/81 |

(Continued)

*Primary Examiner*—Jacob K Ackun, Jr.
(74) *Attorney, Agent, or Firm*—Jay R. Yablon

(57) ABSTRACT

Disclosed is a medical scheduling system to keep the users of medically prescribed medication on their medication-taking schedule. The Med-Sked™ Tab System is a series of Day/Dose tabs that indicate the medication schedule or calendar and confirms that the schedule has been adhered to, when the appropriate tabs are removed. This procedure eliminates the confusion associated with the taking of medication. It assists the user in complying with, and with specificity to prescription and non-prescription medication scheduling. Using a tab residue, It confirms that this has been accomplished when the appropriate Day/Dose Tab has been removed.

16 Claims, 7 Drawing Sheets

U.S. PATENT DOCUMENTS 7,032,535 B2 * 4/2006 Halstead et al. ..... 116/308
7,263,790 B2 9/2007 Richards
7,387,208 B2 6/2008 Londino
7,458,178 B2 12/2008 Paschall
7,597,246 B2 10/2009 Stepanek, Jr.
2001/0030140 A1 10/2001 Mundt
2006/0197336 A1 9/2006 Londino
2006/0278156 A1 12/2006 Miller
2009/0202635 A1 * 8/2009 Scott ..... 424/468

* cited by examiner

DIRECTIONS FOR USING THE MED-SKED TABS

For a medication schedule of 3 Doses per Day, for 10 Days, follow steps #1 through steps #4.

Step #1. Place the Med-Sked Tab System on the medication bottle or box, and proceed to Step #2.
Step #2. For Dose 1 of Day 1, take your first dose from the medication bottle or box, then lift and tear off the Dose 1 tab at the perforation line. Proceed to Step #3.
Step #3. For Dose 2 of Day 1, take your second dose from the medication bottle or box, then lift and tear off the Dose 2 tab at the perforation line. Proceed to Step #4.
Step #4. For Dose 3 of Day 1, take your third dose from the medication bottle or box, then lift and tear off the Dose 3 tab at the perforation line. Proceed to Step #5
Step #5. Repeat the above Step procedures for the prescribed 10 Day schedule.

Figure 12

DIRECTIONS FOR USING THE MED-SKED TABS

For a medication schedule of 1 Dose per Day, for 30 Days, follow steps #1 through steps #5.

Step #1. Place the Med-Sked Tab System on the medication bottle or box, and proceed to Step. #2.
Step #2. For Dose 1 of Day 1, take your first dose from the medication bottle or box, then lift and tear off the Dose 1 tab at the perforation line. Proceed to Step #3.
Step #3. For Dose 1 of Day 2, take your second dose from the medication bottle or box, then lift and tear the Dose 1 tab at the perforation line. Proceed to Step #4.
Step #4. For Dose 1 of Dau 3, take your third dose from the medication bottle or box, then lift and tear the Dose 1 tab at the perforation line. Proceed to Step #5.
Step #5. Repeat the above Step procedures for the prescribed 30 Day schedule.

Figure 13

MEDICATION DOSAGE REMINDER AND CONFIRMATION DEVICE, SYSTEM, METHOD, AND PRODUCT-BY-PROCESS

CROSS-REFERENCE TO RELATED APPLICATION

This application is a continuation of application U.S. Ser. No. 11/163,648 filed Oct. 26, 2005, now U.S. Pat. No. 7,387,208 issued Jun. 17, 2008.

FIELD OF THE INVENTION

This invention relates to the field of medication dosage tracking, and in particular, to a system which allows the user of medication to readily track both the dosages that need to be taken as well as those that have already been taken.

BACKGROUND OF THE INVENTION

Most practitioner-prescribed medication, as well as over-the-counter medication, requires regimented usage for optimal results. In our fast paced society, it is difficult for most people to maintain a medication-related schedule and to remember what has been taken and what still needs to be taken.

A survey of approximately one hundred people who take or have taken medication (the survey included pharmacists) was conducted by applicant to substantiate the belief that most people forget, or have forgotten to take their medication. The results of the survey was that ninety-nine percent of those people surveyed forget to take their medication, and that the majority of people forget to take their medications, more often than not. Not only do most people forget to take their medication, but just as important, most people, while in the process of remembering to take their medication, often forget if they have taken their last scheduled dose or not.

It is therefore desirable to have a reminder system which indicates not only when the medication is scheduled to be taken according to the medication schedule, but also contains some visible evidence attesting to the day-schedule on which the doses were to be taken and have already been taken.

In particular, it is desirable for such reminder system to confirm that a particular medication dose has been taken as a consequence of removing reminder tabs from the system at the time a medication is taken, as well as to indicate what dosages still need to be taken.

In other words, there should be no doubt for the user, about when the medication should be taken. And, there should be no confusion for the user, as to whether or not the medication has been taken.

SUMMARY OF THE INVENTION

This invention relates to a system of Day/Dose tear-off tabs, which allows the user of medication to adhere to a medication schedule, with respect to dates or days of any calendar day, week, or month, in any sequence that is determined by the medication schedule. The invention also allows the user to easily determine if the scheduled dose or doses have been taken on the scheduled date/day, and indicates when the next scheduled dose is due to be taken, by viewing the visible residue Day tabs, and removing/tearing off the Dose tabs appropriately.

This Med-Sked™ Tab System is used in conjunction with the consumption of any type of medication produced. The Tab System can also be used in accordance with over-the-counter medication. The System has specific Day/Dose tabs, which can be used for any prescribed schedule, but not limited to, numbering anywhere from, or numbering anywhere in between, or any combination of numbers and dates, the numbers corresponding to calendar days one through thirty one. These Day/Dose tabs correspond with the prescribed Day/Dose dosage of any type of medication. The tab system is specifically designed for, but not limited to, a medication schedule wherein one or more doses of meds are to be taken within the course of one day, for any number of days. While the dose tabs are torn off as each dose is taken, a corresponding Day Tab Residue remains adhered to the bottle or package, to indicate to the user both what has been taken, and also whether or not there are more doses to be taken that day or on a later day, until the medication is taken in its entirety. The innovative feature of this invention is in its simplicity. It is revolutionary in that it requires no electronic equipment, requires no complicated mechanics and requires no maintenance to perform its function. And, it not only tell the user what needs to be taken next, but also confirms for the user what has been taken by virtue of the tab "residue."

The function of the Med-Sked™ Tab System is to keep the users of medically prescribed medication on their medication-taking schedule. The Med-Sked™ Tab System is a series of Day/Dose tabs that indicate the medication schedule or calendar and confirms that the schedule has been adhered to, when the appropriate tabs are removed. This procedure eliminates the confusion associated with the taking of medication. It assists the user in complying with, and with specificity to prescription and non-prescription medication scheduling. Using a tab residue, It confirms that this has been accomplished when the appropriate Day/Dose Tab has been removed.

The Med-Sked™ Tab System may be affixed to, or incorporated into, any medication packaging.

The Med-Sked™ Tab System reduces or eliminates the possibility of overdose or under-dose.

The Med-Sked™ Tab System may be manufactured in a variety of materials.

The Med-Sked™ Tab System's dimensions may be adjusted accordingly to accommodate a variety of medication containers.

The Med-Sked™ Tab System may be affixed, through the use of adhesives, magnets, or other attachment/adhering devices and methods known or which may become known in the art, to a multitude of surfaces.

Disclosed is a device, system, method, and product-by-process for tracking consumption of a medication which is taken N doses per day where N>1, for a plurality of days, the system comprising: a top tab layer comprising a plurality of top layer day-dose tabs, each top layer day-dose tab comprising a top layer day-day indicator designation and a top layer dose number designation; a bottom tab layer comprising a plurality of bottom layer day-dose tabs, each bottom layer day-dose tab comprising a bottom layer day-day indicator designation and a bottom layer dose number designation; if N>2, N-2 intermediate tab layers between the top and bottom tab layers, comprising a plurality of intermediate layer day-dose tabs, each intermediate layer day-dose tab comprising an intermediate layer day-day indicator designation and an intermediate layer dose number designation; each of the top and bottom tab layers, and all of the intermediate layers, if any, comprising tearable perforation lines between the layer's day-day indicator designations, and the layer's dose number designations; and the top layer day and day indicator designations adhered over the bottom layer day and day indicator designations, and if there are any intermediate layers, via being adhered over the day but not day indicator designations of the intermediate layers; wherein: when a dose number designation portion of a tab of the top or bottom tab layers, or, if any, the intermediate layers, is pulled with a force sufficient to cause a tear along the perforation line, the pulled tab tears along the perforation line and the adhesion causes the day-day indicator designation of the pulled tab to remain adhered in place to the next-lower tab layer as a residue while the dose number designation of the pulled tab is torn away, the residue thereby indicating that the dose number for the day has been consumed and the remaining unpulled tabs indicating what doses still remain to be taken.

Also disclosed is a device, system, method, and product-by-process for tracking consumption a medication which is taken one dose per day for a plurality of days, the system comprising: a top tab layer comprising a plurality of top layer day tabs, each top layer day tab comprising a top layer day-day indicator designation; a bottom tab layer comprising a plurality of bottom layer day tabs, each bottom layer day tab comprising a bottom layer day-day indicator designation; each of the top and bottom tab layers comprising tearable perforation lines between the layer's day designation, and the layer's day indicator designation; the top layer day but not day indicator designations adhered over the bottom layer day but not day indicator designations; wherein: when a tab of the top or bottom tab layers is pulled with a force sufficient to cause a tear along the perforation line, the pulled tab tears along the perforation line and the adhesion causes the day designation of the pulled tab to remain adhered in place to the next-lower tab layer as a residue while the day indicator of the pulled tab is torn away, the residue thereby indicating that the dose for the day corresponding to the torn-off day indicator has been consumed and the remaining unpulled tabs indicating the days for which doses still remain to be taken.

BRIEF DESCRIPTION OF THE DRAWINGS

The features of the invention believed to be novel are set forth in the appended claims.

The invention, however, together with further objects and advantages thereof, may best be understood by reference to the following description taken in conjunction with the accompanying drawing(s) summarized below.

FIG. 1 exemplifies a ten-day system for three doses per day. FIG. 2 exemplifies a thirty-day system for one dose per day. These are by way of illustration only, and these illustrated examples do not in any way serve to limit the range of medication dosage calendars that can be represented in accordance with the invention.

FIGS. 7 and 8 illustrate the embodiments of the preceding figures, with all layers of tabs assembled and affixed together, as well as the manner in which tabs are removed to indicate that a particular dose has been taken. These two figures illustrate the manner in which various embodiments of the invention would typically be provided to the medication consumer for use with a medication, whereas FIGS. 1 through 6 illustrate "pre-assembled" representations of invention embodiments.

FIGS. 12 and 13 illustrate sample, for illustration not limitation, of directions for using the Med-Sked™ tab systems of FIGS. 1, 3, 5, 7 and 2, 4, 6, 8, respectively.

DETAILED DESCRIPTION

Figure 1:
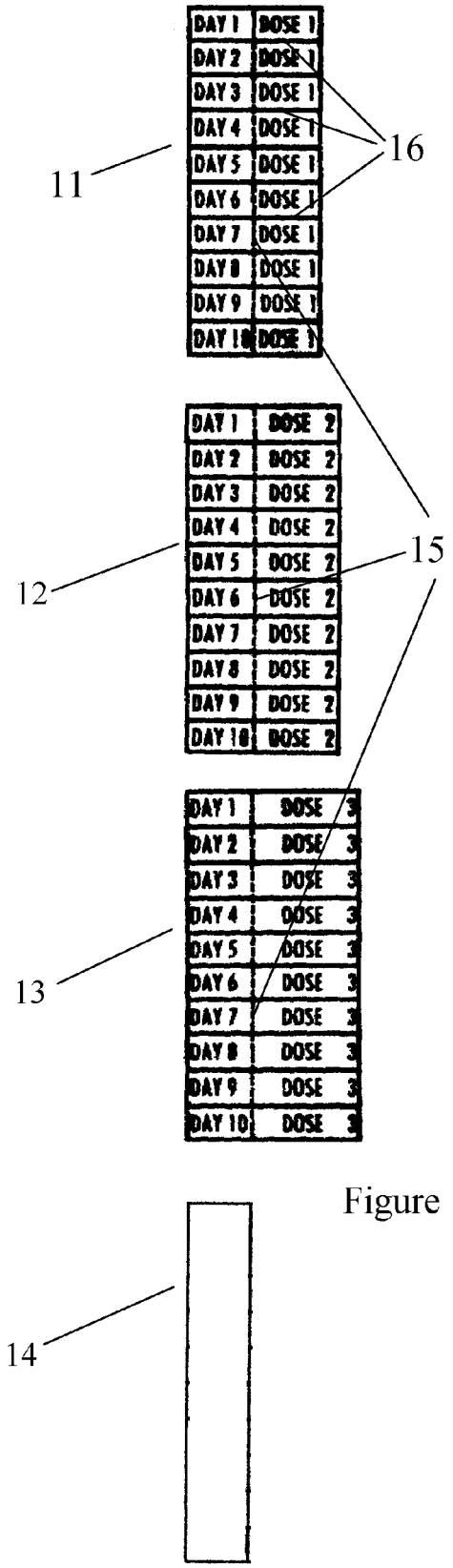
FIGS. 1 and 2 illustrate the right/left alignment of three layers of tabs in accordance with an embodiment of the invention, as well as a fourth, underlying affixation layer for affixing the tab system to medication packaging.
Figure 2:
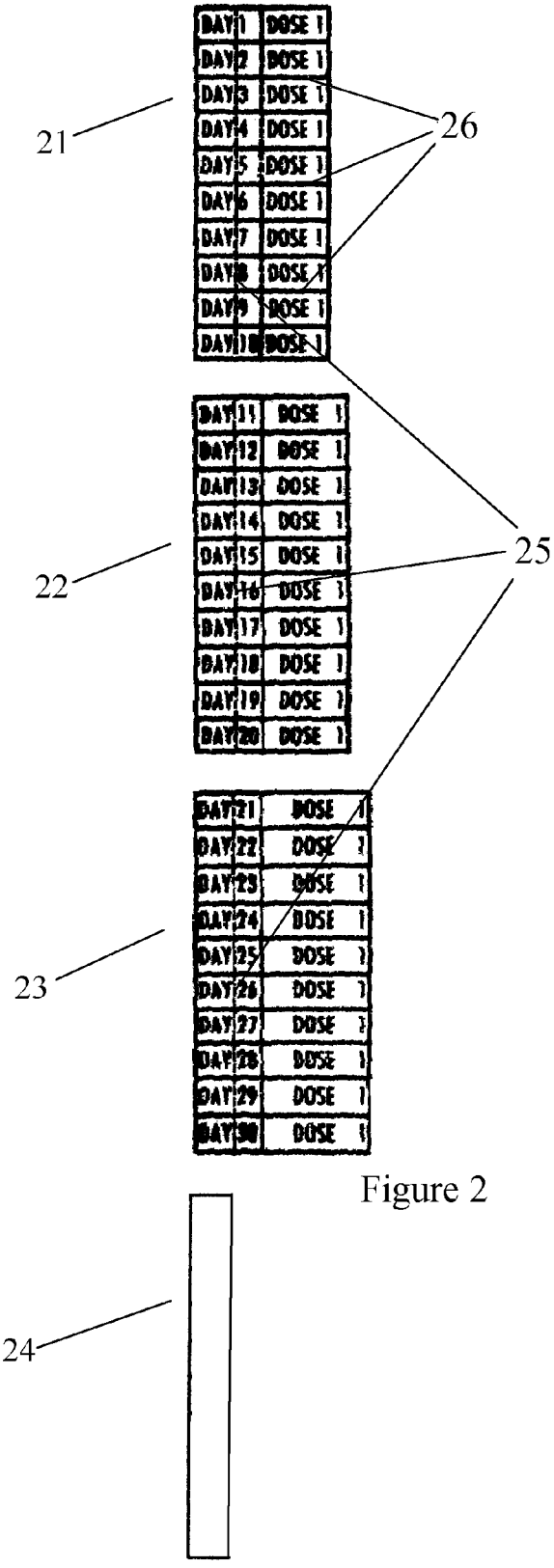

Referring to FIGS. 1 and 2, it is seen that that the top tab layers 11 and 21 are slightly narrower than the middle tab layers 12 and 22, which in turn are slightly narrower than the bottom tab layers 13 and 23. It is also seen in FIG. 1 that the underlying affixation layer 14 is approximately equal in width to that of the "day tab" portion of the top 11, middle 12 and bottom 13 tab layers, including a day indicator for the day (e.g., number of the day or day of the week, etc.), while in FIG. 2, the underlying affixation layer 24 is approximately equal in width to that of the "day tab" portion of the top 21, middle 22 and bottom 23 tab layers, excluding the day indicator, (e.g., number of the day, day of the week). Note that affixation layer 14 in the FIG. 1 embodiment is preferably wider than narrower affixation layer 24 in the FIG. 2 embodiment, as will be elaborated below. Affixation layers 14 and 24 adhere on both sides (preferably, beneath 14 and 24 is a peel-off protective sheet), and the adhesive on the underside of 14 and 24 is used to adhere these to a mounting location, e.g., the medicine container, box, etc. (packaging).

For the multidose-per-day embodiment of FIG. 1, there is a tearable perforation line 15 between the day portion of the tab including the day indicator, and the dose portion of the tab. For the single-dose-per day embodiment of FIG. 2, there is a tearable perforation 25 between the word "day" and the day indicator so that when an upper 21 or middle 22 tab is removed, the day indicator on the middle 22 or bottom 23 tab, respectively, is readily revealed to visual inspection.

The dimensions of the tab system may readily be varied. For illustration, and not limitation, in a preferred embodiment the top-to-bottom length of the entire system is approximately 2 3/16". Similarly, it is preferred, but not at all limiting, for the top layers 11 and 21 to be 13/16" in width, for the middle layers 12 and 22 to be 15/16" in width, and for the bottom layers 13 and 23 to be 1 1/16" in width, all approximately. For the FIG. 1 system, which illustrates multiple doses per day (and in this specific, non-limiting illustration, three doses per day for each of ten days), perforation 15 is preferably approximately 7/16" from the left edge of each layer (and wider affixation layer 14 correspondingly, is preferably approximately 7/16" in width), and between each tab, there are horizontal cuts 16. For the FIG. 2 system, which illustrates a single dose per day (and in this specific, non-limiting illustration, one dose per day for each of thirty days), perforation 25 is preferably approximately 4/16" from the left edge of each layer (and narrower affixation layer 24 correspondingly, is preferably 4/16" in width). Between each tab, again, are horizontal cuts 26. Because perforation 15 in the FIG. 1 embodiment is between the day/day indicator and the dose number, when a tab is removed from this system, the day indicator remains intact.

Because perforation 25 in the FIG. 2 embodiment is between the word "day" and the day indicator, when a tab is removed from this system, the day indicator is also removed, so that a different day indicator just beneath becomes exposed to view.

Figure 3:
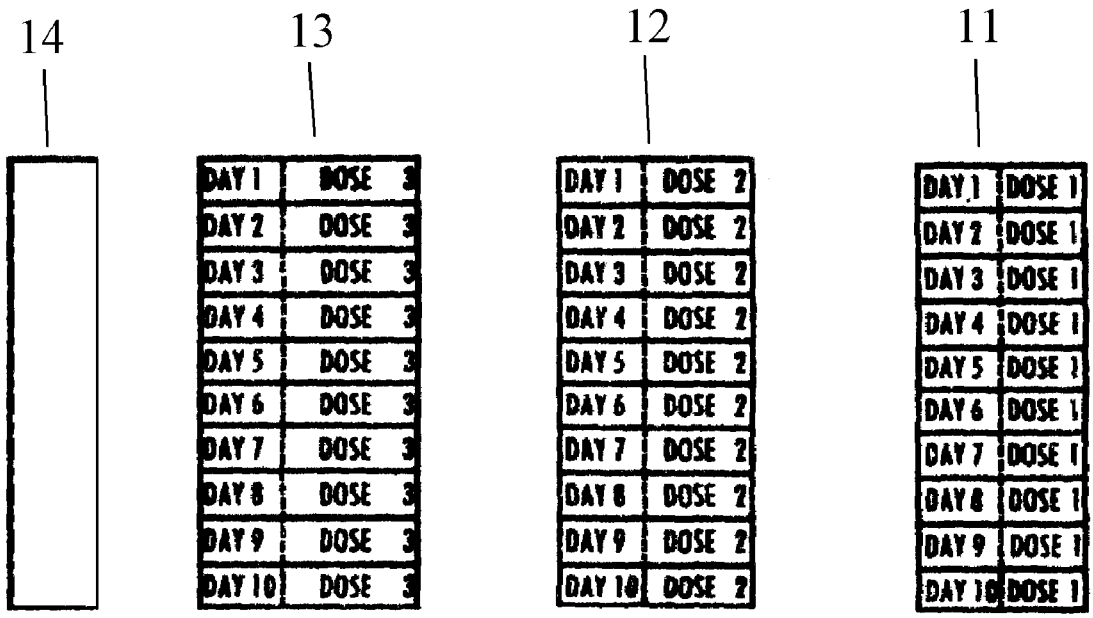
FIGS. 3 and 4 respectively illustrate the up/down alignment of the exemplary three layers of tabs illustrated in FIGS. 1 and 2.
Figure 4:
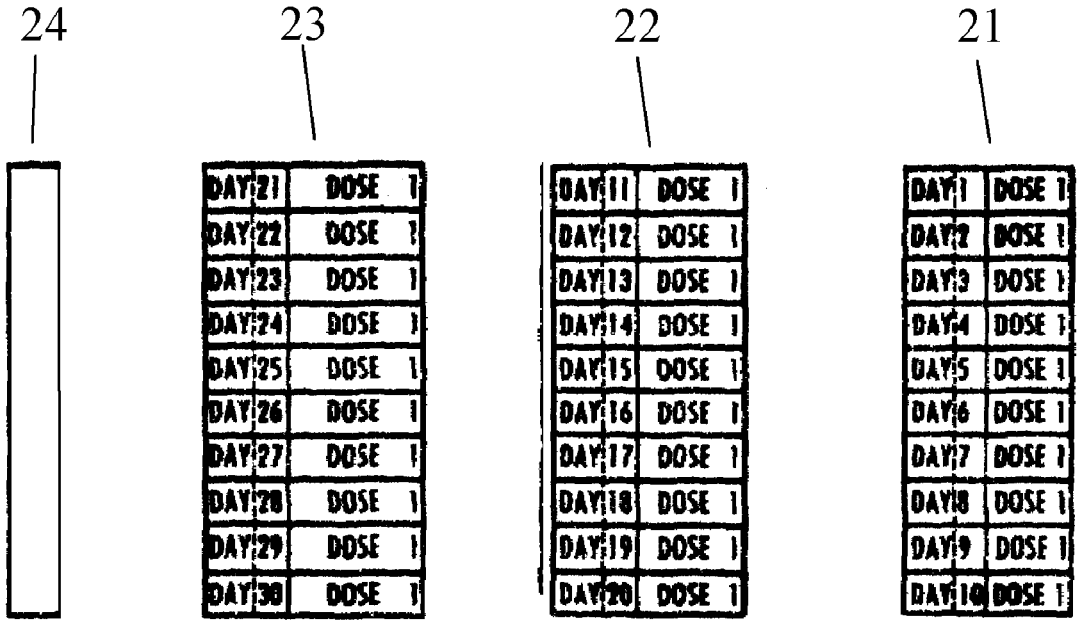
Figure 5:
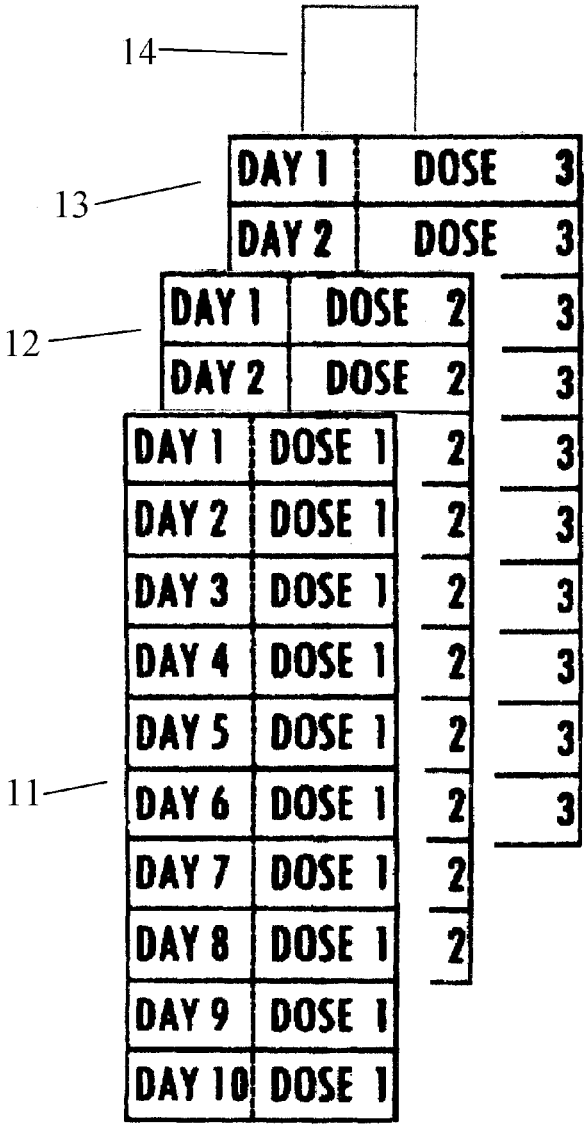
FIGS. 5 and 6 illustrate the manner in which the exemplary tabs illustrated in FIG. 1 through 4 are overlaid onto one another and affixed together to assemble the embodiment of FIGS. 1 through 4.
Figure 6:
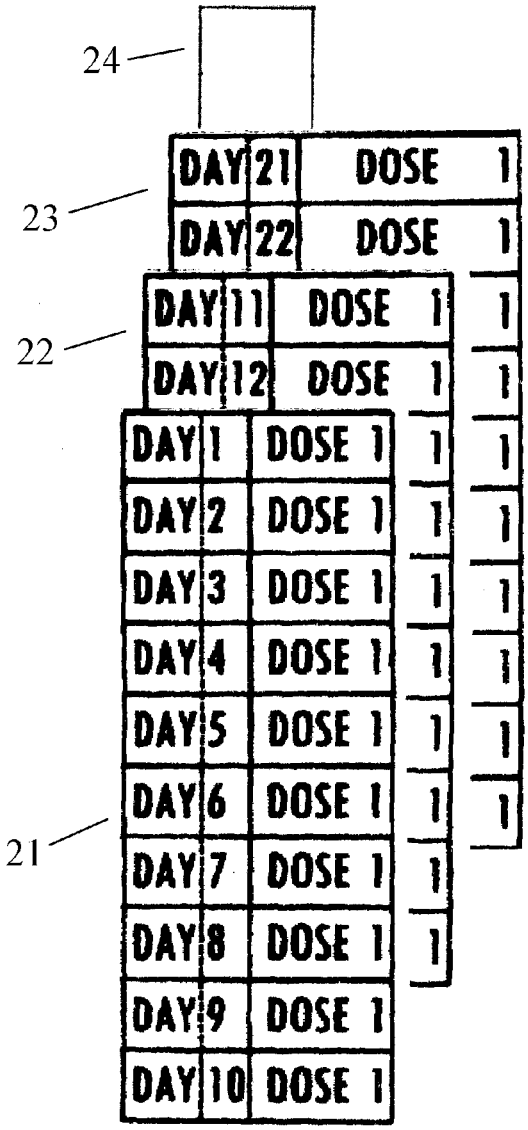

FIGS. 3 and 4 illustrate the same as FIGS. 1 and 2 respectively, except that here the tabs are shown in a right-to-left placement for comparison of how the vertical elements align, whereas FIGS. 1 and 2 illustrate the horizontal alignment. FIGS. 5 and 6 similarly illustrate the way in which the layers are overlaid, resulting in the configuration of FIGS. 7 and 8.

Figure 7:
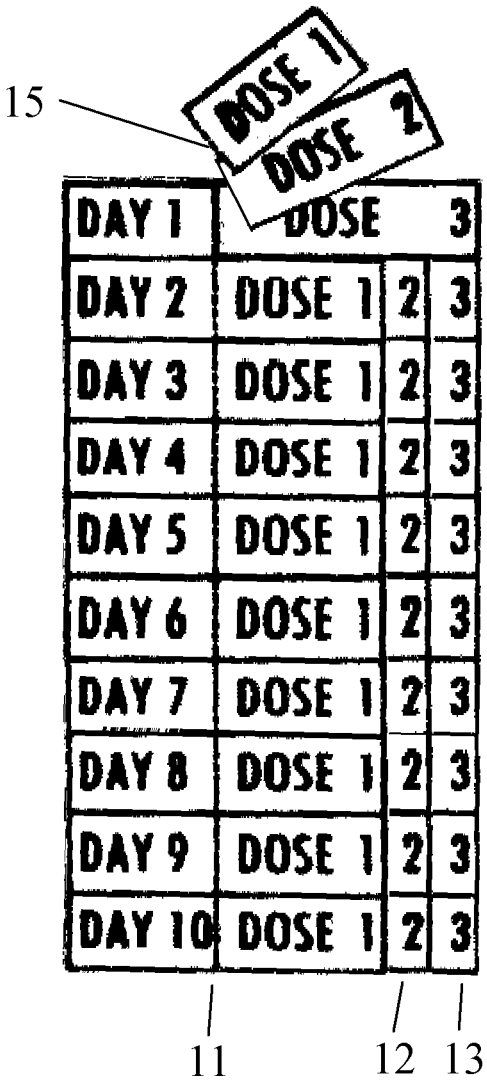

In relation to the illustrative embodiment of FIGS. 1, 3, 5, and 7, top layer 11 is adhered to middle layer 12 beneath where the word "day" (or a similar suitable indicator for a day) as well as beneath the day indicator; middle layer 12 is adhered to bottom layer 13 also beneath where the word "day" and the day indicator; and bottom layer 13 is adhered to wider affixation layer 14, also beneath where the word "day" and the day indicator. All of these are adhered with sufficient strength such that, when a dose is taken and the dose tab is torn along perforation 15, the word "day" and the day indicator both remain intact as an indicator "residue." In this way, the user can keep track both that a dose has been taken together with what dose needs to be taken next. For example, as illustrated in FIG. 7, once the "dose 1" and "dose 2" tabs are torn at perforation 15, the user visually sees only "day 1, dose 3" remaining. This tells the user not only that day 1, dose 3 is the next dose, but also, by virtue of the day 1 residue which contains an affirmative indicator which was formerly part of (a residue from) the indictor from dose that has now been consumed, that the first two doses from day 1 have already been consumed. Note, this "residue" is more than just the tape or glue or the nub from a removed tab, which can be inconclusive in its meaning. This residue, again, contains an affirmative remaining (unremoved) indicator which was earlier associated with a dose that has now been consumed. Thus, the indicators which are displayed to visual inspection once doses have been taken relate to and originate from both doses which have already been taken as well as doses which still need to be taken.

Figure 8:
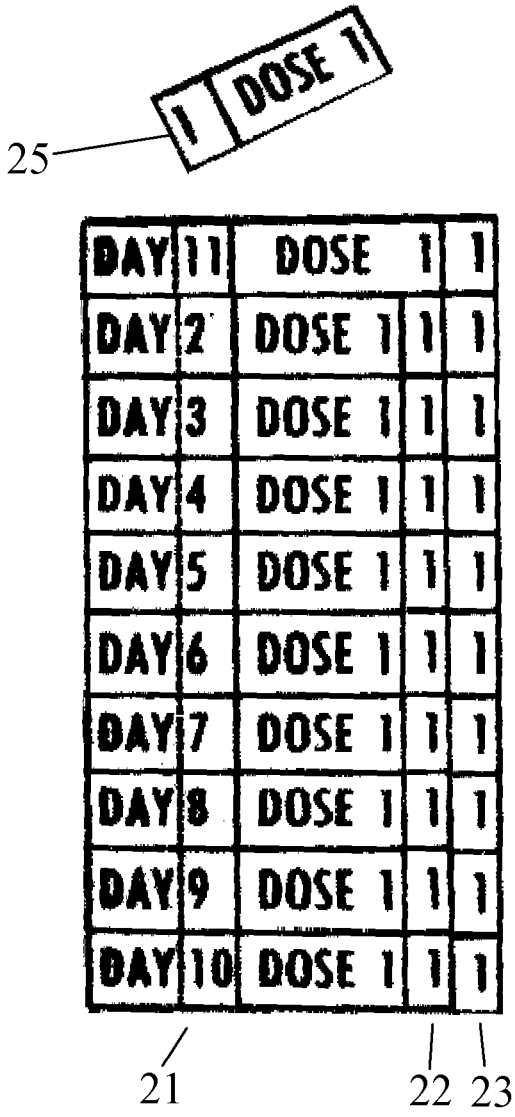

In relation to FIGS. 2, 4, 6, and 8, top layer 21 is adhered to middle layer 22 beneath the word "day," but not beneath the day indicator. Middle layer 22 is adhered to bottom layer 23 also beneath the word "day" but not beneath the day indicator; and bottom layer 23 is adhered to wider affixation layer 24, also beneath the word "day" but not the day indicator. All of these are adhered with sufficient strength such that, when a dose is taken and the dose tab is torn along perforation 25, the word "day" remains intact, again, as a "residue." But, in contrast to FIGS. 1, 3, 5, and 7, the day indicator from the next lower layer is exposed. Again, this enables the user to keep track both that a dose has been taken together with what dose needs to be taken next, by maintaining an affirmative visual indicator—more than tape or glue or nub—from doses already taken as well as doses still to be taken. For example, as illustrated in FIG. 8, when the "1" from day 1 is torn away along perforation 25 together with the dose 1 indicator, the "11" for day 11 is exposed. It is clear to the user from both the day 1 residue (here, the word "day") as well as the now-visible "11" that the day 1 dose has been consumed, and that the day 2 dose is next to be consumed. When all of the dosages for days 1 through 10 are completed, the user will see all of day indicators 11 through 20 exposed, and will begin to cycle through the second layer 22, see FIGS. 1, 3 and 5. Completion of the second layer cycle then leaves the third layer 23 for days 21 through 30, again, see FIGS. 1, 3 and 5.

The directions for using the tab system, for the example of a medication that is taken three times per day for 10 days, would be as follows:

On day 1, consumer takes Dose 1 of medication from the bottle or box, then lifts and tears off the tab for Dose 1 adjacent to Day 1, at the perforation line 15.

Later on day 1, consumer takes Dose 2 of medication from the bottle or box, then lifts and tears off the tab for Dose 2 adjacent to Day 1, again at the perforation line 15.

Consumer continues this medication schedule, tearing off all dose tabs from top 11, middle 12, and bottom 13 layers, for the prescribed 10 days, until the medication is taken in its entirety.

For the example of one dose per day for 30 days, the consumer removes tabs so as to cycle through the first 10 days, which exposes days 11 through 20. Then, the consumer cycles through and removes tabs for the next 10 days, exposing days 21 through 30. Finally, the consumer cycles through and removes tabs for the final 10 days.

In all cases, there is never any doubt whether a dose has been taken, nor is there any doubt which dose needs to be taken next.

While the examples used here are for ten days at three doses per day and thirty days at one dose per day, this is exemplary and not limiting. For one week of medication taken four times per day, one would have seven tabs per layer, and four layers. For two weeks of medication taken twice a day, one might have seven tabs per layer and four layers, but differently marked so that when the day 1 dose 1 is taken, a day 1 dose 2 tab is exposed, and when that is taken a day 8 dose 1 tab is next exposed, followed by a day 8 dose 2 tab. Whether one elongates the top-to-bottom length of this system and thus uses more tab per layer, or adds additional layers, will depend on the particulars of the dosage schedule to be represented, as well as how much physical space is expected to be available on the mounting surface to which the system is to be mounted. Other combinations will become readily apparent to someone of ordinary skill, and are envisioned to be within the scope of this disclosure and its associated claims.

Similarly, the use of "day 1," "day 2" etc, is illustrative, but not limiting. For example, not limitation, the days can simply be represented by calendar numbers, e.g., 1 through 31. Or, by days of the week such as "Sunday" through "Saturday" which may employ a seven-tab-per-layer embodiment. Then, if the user starts consuming medication on, e.g., a Wednesday, the first tear-off will occur for the Wednesday tab in the middle of top layer of the tab system, and will cycle back to the Tuesday tab also in the middle of the first layer, before staring the second layer on its Wednesday tab. For a 30-day calendar month, for example, one might have 30 distinct embodiments, so that if a medication is begun on the 23$^{rd}$ of the month, the number "23" appears as the first tab, the top layer contains all of 23 through 30 and 1 and 2 (ten tabs per layer), the middle layer contains all of 3 through 12, and the bottom layer all of 13 through 22. In sum, the day indicator designations may comprise a sequence of numbers beginning at 1, or a sequence of numbers representing days on a calendar, or a sequence of markings representing days of the week, or any other suitable representation of specific days. Again, other variations of this nature will become apparent to someone of ordinary skill based on this disclosure, and are regarded to be within the scope of this disclosure and its associated claims.

As a more detailed example of use, consider the example of Amoxicillin, prescribed to be taken three times a day, for ten days. The consumer receives the Amoxicillin from the pharmacy, then affixes the Med-Sked™ Tab System to the medication package/container. The consumer takes the first dose of Amoxicillin, then tears off the Dose 1 tab (adjacent to the Day 1 tab). The remaining Dose 2 and Dose 3 tabs, along with the corresponding Day 1 tab is left adhered to the medication package/container to indicate that the user has taken Dose 1, but has yet to take Dose 2 and Dose 3 for the remaining Day 1. The user then takes the second dose of Amoxicillin, according to the medication schedule, and tears off the Dose 2 tab adjacent to the Day 1 tab. The remaining Dose 3 tab, along with the Day 1 tab is left adhered to the medication package/container to indicate that the user has taken Dose 2, but has yet to take Dose 3 for the remaining Day 1 schedule. The user then takes the third and final dose of Amoxicillin for Day 1. The user tears of the Dose 3 tab. There are no more Dose tabs left for Day 1, which indicates that the user has taken all 3 doses for Day 1.

The Day 1 tab is left adhered to the package/container as a residue to act as confirmation that all doses for Day 1 were taken according to the medication schedule.

The above procedure is repeated for (but not limited to) the 10 day medication schedule.

To manufacture the embodiments described above for use by a consumer, one first cuts and prints/marks a plurality of tab layers along the lines of FIGS. 1-4. This includes making horizontal cuts 16, 26, as well as, e.g., scoring the perforations 15, 25. Then, the top layers 11, 21 are adhered to the middle layers 12, 22, the middle layers 12, 22 are adhered to the bottom layers 13, 23, and the bottom layers 13, 23 are adhered to the "top" side of the affixation layers 14 and 24. All of this is done such that the tabs will tear properly along the perforation lines and leave the required residues through which the consumer can be reminded what doses have been taken and what doses need to next be taken. As noted above, affixation layers 14 and 24 also contain, for example, an adhesive on their underside, protected, for example, by a peel-off protective sheet. When manufactured, the protective sheet remains adhered. The consumer peels off this sheet to expose the underside adhesive, and uses this to affix the entire Med-Sked™ system to the mounting surface, e.g., medication packaging.

Frequently, when a consumer begins a prescription for a medication that is taken two or more times per day, not all of the daily doses are consumed on the first day, and this will leave extra doses to be consumed following the last day. For example, for the three-dose-per-day, ten-day prescription (30 doses total) illustrated in FIGS. 1, 3, 5 and 7, the consumer may pick up the prescription from the pharmacy on the afternoon of the first day and so skip the morning dose for that day. Or, the consumer may pick up the prescription from the pharmacy on the evening of the first day and so skip both the morning and afternoon doses for that day. In the former case the consumer takes two doses (afternoon and evening) the first day, and has one dose left over which will actually need to be consumed on the morning of the $11^{th}$ day. In the latter case, the consumer takes only one dose (evening) the first day, and so has two doses left over which will need to be consumed on the morning and afternoon of the $11^{th}$ day.

Figure 9:
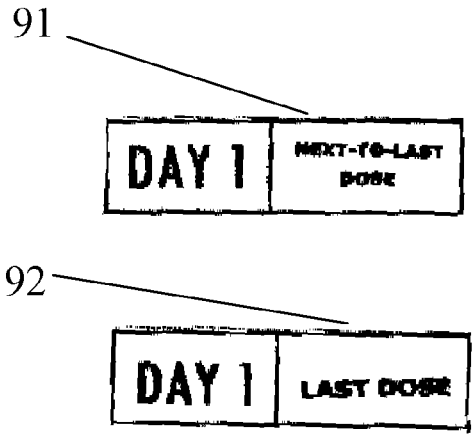
FIG. 9 illustrates last dose and next-to-last-dose indicators for reconfiguring one or two of the first day tabs into last day tabs, for the common situation where all daily dosages of a medication are not consumed in the first day.
Figure 10:
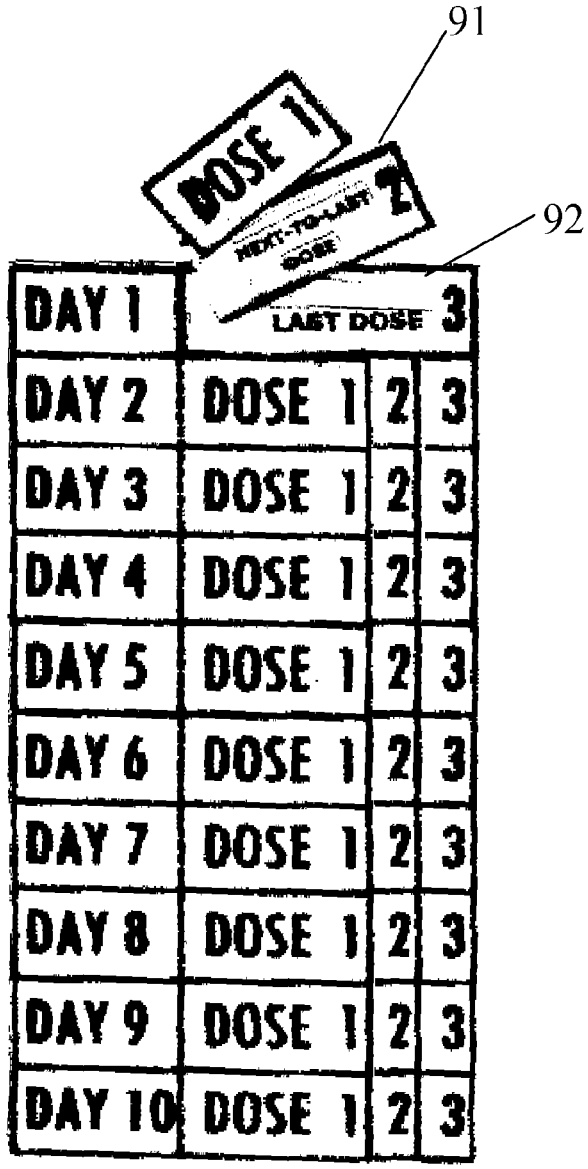
FIG. 10 illustrates the one or two of the first day tabs reconfigured into last dose and next-to-last-dose tabs, using the last dose and next-to-last-dose indicators of FIG. 9.

FIGS. 9 and 10 illustrate an example of how to employ the Med-Sked™ to deal with this type of situation. Fundamentally, one addresses this situation by redesignating the "day 1/dose 3" tabs, and possibly the "day 1/dose 2" tabs, respectively, into next-to-last-dose and last-dose tabs. For example, if the consumer only takes two doses the first day, then the unused day "day 1/dose 3" tab is redesignated into a "last dose" tab. If the consumer only takes one dose the first day, then the unused "day 1/dose 3" tab is redesignated into a "last dose" tab, and in addition, the unused "day 1/dose 2" tab is redesignated into a "next-to-last dose" tab. If there are more than three doses per day, then one would need to further redesignate others of the day 1 tabs into "third-from-last dose," "fourth-from-last dose," etc.

A particular embodiment for managing this redesignation is illustrated, for example but not limitation, in FIGS. 9 and 10. In this embodiment, the Med-Sked™ system comprises two extra redesignation tabs (for three doses per day) with adhesive backing (and a removable protective layer over the adhesive) which can be adhered to the "day 1/dose 2" and the "day 1/dose 3" tabs as needed, to redesignate the meaning of these tabs as just discussed. One of these redesignation tabs is a "next-to-last dose" tab 91. The other is a "last dose" tab 92. For N doses per day, a total of N-1 such redesignation tabs are provided.

However, one can employ other devices and methods for doing this as well. The consumer, for example, might simply use a marking pen or pencil to redesignate these tabs. The "day 1/dose 2" and the "day 1/dose 3" tabs might be manufactured wider (left-to-right in the drawings) than all of the other tabs, with a scoring line along which they may be reduced by tearing down to their original, illustrated widths. By leaving these tabs elongated, that would mean that these are to be regarded as "last dose" and "next-to-last dose" tabs. By removing the extra width before use, this would mean that these continue to be first day dose tabs. Other methods that may become apparent of ordinary skill for redesignating certain tabs from one indication to another indication are considered to be within the scope of this disclosure and its associated claims.

While FIGS. 2, 4, 6, and 8 all illustrate "day," the "day indicator," and the "dose number," it is recognized that the dose number tab may actually be superfluous and thus omitted, because this is a one-dose-per-day system and the dose taken on any given day will always be "dose 1," and indeed the only dose, for that day. The presence of the "dose 1" tab section illustrated in FIGS. 2, 4, 6, and 8, therefore, serves to elongate the tab to make it easier to pull, but this printed matter can also be omitted and the tab simply provided in elongated form to facilitate pulling and separation. What is most important for this one-dose-per-day embodiment, is the tearing between the "day" and the "day indicator," so as to expose the underlying day indicator, that is, for example, to tear off the "1" of day 1 so as to expose the "11" of day 11, again, see FIG. 8.

Figure 11:
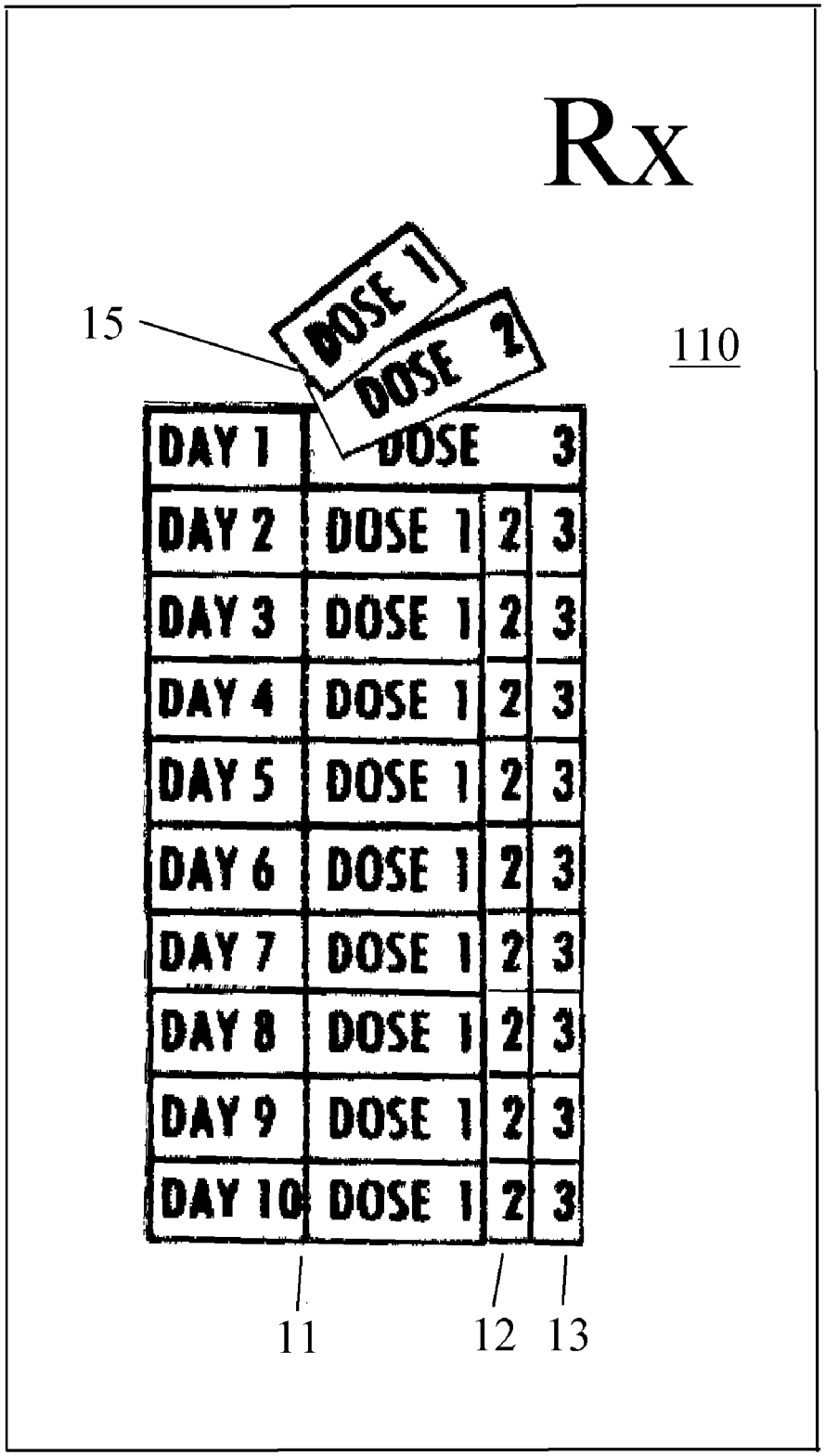
FIG. 11 illustrates the invention embodiment of FIG. 7, as mounted on medication packaging.

It is not strictly necessary, but is preferred, that this system be mounted on a mounting location on the medication packaging 110 as illustrated in FIG. 11. A consumer might wish, for example, not limitation, to affix the Med-Sked™ system to a counter space, or a sheet of paper, or to a wall (in which case a Post-It® type of adhesive backing is preferred for affixation layers 14 and 24), or to a refrigerator (in which case a magnetic backing is suitable), or to an automobile dashboard or visor, or to any other mounting location that suits the consumer's convenience. Irrespective of the exact mode of affixation, or what mounting location the consumer chooses to affix the Med-Sked™ to based on personal preference and convenience, it is understood that the means is provided for the consumer to affix the Med-Sked™ to a suitable location that will often be the medicine packaging. And, it is understood that affixation means which employ other than glue or tape may alternatively be provided within the scope of this disclosure and its associated claims.

While the tabs illustrated here use the word "day" together with a day indicator, and the word "dose" together with a dose number, to remind the user of what medication have been taken and still need to be taken, it will be understood by someone of ordinary skill that other words or indicators may be used. Any word, coloration, marking, shape, or other visual indicator which the user understands to mean "day," and/or "dose," with or without the actual words "day" and/or "dose" or synonyms therefore, is understood to fall within the scope of this disclosure and its associated claims.

Similarly, while the ends of the tabs are all shown to be squared off, these can also be rounded, or have some other shape. That is, the particular squared shape illustrated in the various drawings is to be understood as exemplary, and not limiting.

Further, while the bottom layers 13 and 23 are illustrated to be the widest, and the top layers 11 and 21 are illustrated to be the narrowest, this is exemplary, not limiting. For example, it is possible to have a reverse scheme in which the top layers are the widest and the bottom layers narrowest. Also, for example, it is possible for all of the widths to be substantially the same. Also, it is possible for the widths to be varied in any other way consistent with space requirements, ease of removing tabs, and reliability of the indication that a does has been or still needs to be consumed.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A system for tracking consumption of a medication which is taken N doses per day where N>1, for a plurality of days, comprising:

a top tab layer comprising a plurality of top layer day-dose tabs, each said top layer day-dose tab comprising a top layer day-day indicator designation and a top layer dose number designation;

a bottom tab layer comprising a plurality of bottom layer day-dose tabs, each said bottom layer day-dose tab comprising a bottom layer day-day indicator designation and a bottom layer dose number designation;

each of said top and bottom tab layers, comprising tearable perforation lines between said layer's day-day indicator designations, and said layer's dose number designations; and said top layer day and day indicator designations adhered over said bottom layer day and day indicator designations; wherein:

when a dose number designation portion of a tab of said top or bottom tab layers is pulled with a force sufficient to cause a tear along said perforation line, the pulled tab tears along said perforation line and the adhesion causes said day-day indicator designation of said pulled tab to remain adhered in place to the next-lower tab layer as a residue while the dose number designation of said pulled tab is torn away, said residue thereby indicating that said dose number for said day has been consumed and the remaining unpulled tabs indicating what doses still remain to be taken.

2. The system of claim 1, further comprising:

an affixation layer adhered to and below said bottom layer day and day indicator designations, for affixing said system to a mounting location.

3. The system of claim 2, in combination with a medication packaging of said medication, wherein:

said medication packaging comprises said mounting location; and said affixation layer is adhered to said mounting location.

4. The system of claim 1, further comprising a last dose indicator, for redesignating a first day-dose tab to be a last dose tab.

5. The system of claim 1, further comprising M-1 indicators ranging from a last dose indicator through a $(M-1)^{th}$ -from-last dose indicator, for redesignating up to M-1 first day-dose tabs to be $(M-1)^{th}$-from-last dose through last dose tabs.

6. A system for tracking consumption a medication which is taken one dose per day for a plurality of days, comprising:

a top tab layer comprising a plurality of top layer day tabs, each said top layer day tab comprising a top layer day-day indicator designation;

a bottom tab layer comprising a plurality of bottom layer day tabs, each said bottom layer day tab comprising a bottom layer day-day indicator designation;

each of said top and bottom tab layers comprising tearable perforation lines between said layer's day designation, and said layer's day indicator designation;

said top layer day but not day indicator designations adhered over said bottom layer day but not day indicator designations; wherein:

when a tab of said top or bottom tab layers is pulled with a force sufficient to cause a tear along said perforation line, the pulled tab tears along said perforation line and the adhesion causes said day designation of said pulled tab to remain adhered in place to the next-lower tab layer as a residue while the day indicator of said pulled tab is torn away, said residue thereby indicating that the dose for the day corresponding to the torn-off day indicator has been consumed and the remaining unpulled tabs indicating the days for which doses still remain to be taken.

7. The system of claim 6, further comprising:

an affixation layer adhered to and below said bottom layer day but not day indicator designations, for affixing said system to a mounting location.

8. The system of claim 7, in combination with a medication packaging of said medication, wherein:

said medication packaging comprises said mounting location; and said affixation layer is adhered to said mounting location.

9. A method for tracking consumption of a medication which is taken N doses per day where N>1, for a plurality of days, comprising:

pulling a dose number designation portion of a tab of top or bottom tab layers with a force sufficient to cause a tear along a tearable perforation line, such that the pulled tab tears along said perforation line and an adhesive force causes a day-day indicator designation of said pulled tab to remain adhered in place to the next-lower tab layer as a residue while a dose number designation of said pulled tab is torn away, said residue thereby indicating that said dose number for said day has been consumed and the remaining unpulled tabs indicating what doses still remain to be taken, wherein:

said top tab layer comprises a plurality of top layer day-dose tabs, each said top layer day-dose tab comprising a top layer day-day indicator designation and a top layer dose number designation;

said bottom tab layer comprises a plurality of bottom layer day-dose tabs, each said bottom layer day-dose tab comprising a bottom layer day-day indicator designation and a bottom layer dose number designation;

each of said top and bottom tab layers comprise said perforation lines between said layer's day-day indicator designations, and said layer's dose number designations; and said top layer day and day indicator designations are adhered over said bottom layer day and day indicator designations.

10. The method of claim 9, further comprising:

affixing said tab layers to a mounting location using an affixation layer adhered to and below said bottom layer day and day indicator designations.

11. The method of claim 10, a medication packaging of said medication comprising said mounting location, further comprising:

adhering said affixation layer to said medication packaging.

12. The method of claim 9, further comprising:

redesignating a first day-dose tab to be a last dose tab, using a last dose indicator.

13. The method of claim 9, further comprising:

redesignating up to M-1 first day-dose tabs to be $(M-1)^{th}$-from-last dose through last dose tabs, using M-1 indicators ranging from a last dose indicator through a $(M-1)^{th}$-from-last dose indicator.

14. A method for tracking consumption a medication which is taken one dose per day for a plurality of days, comprising:

pulling a tab of top or bottom tab layers with a force sufficient to cause a tear along a tearable perforation line, such that the pulled tab tears along said perforation line and an adhesive force causes a day designation of said pulled tab to remain adhered in place to the next-lower tab layer as a residue while a day indicator of said pulled tab is torn away, said residue thereby indicating that the dose for the day corresponding to a torn-off day indicator has been consumed and the remaining unpulled tabs indicating the days for which doses still remain to be taken; wherein:

said top tab layer comprises a plurality of top layer day tabs, each said top layer day tab comprising a top layer day-day indicator designation;

a bottom tab layer comprises a plurality of bottom layer day tabs, each said bottom layer day tab comprising a bottom layer day-day indicator designation;

each of said top and bottom tab layers comprises said perforation lines between said layer's day designation, and said layer's day indicator designation;

said top layer day but not day indicator designations are adhered over said bottom layer day but not day indicator designations.

15. The method of claim 14, further comprising:

affixing said tab layers to a mounting location, using an affixation layer adhered to and below said bottom layer day but not day indicator designations.

16. The method of claim 15, a medication packaging of said medication comprising said mounting location, further comprising:

adhering said affixation layer to said medication packaging.

* * * * *